US009802082B1

(12) United States Patent
Calandro

(10) Patent No.: US 9,802,082 B1
(45) Date of Patent: Oct. 31, 2017

(54) TEXTURED SPORTS BALL

(71) Applicant: Christopher J. Calandro, Frisco, TX (US)

(72) Inventor: Christopher J. Calandro, Frisco, TX (US)

( * ) Notice: Subject to any disclaimer, the term of this patent is extended or adjusted under 35 U.S.C. 154(b) by 0 days.

(21) Appl. No.: 14/990,855

(22) Filed: Jan. 8, 2016

Related U.S. Application Data

(63) Continuation-in-part of application No. 14/471,066, filed on Aug. 28, 2014, now abandoned.

(51) Int. Cl.
*A63B 41/08* (2006.01)

(52) U.S. Cl.
CPC ..... *A63B 41/08* (2013.01)

(58) Field of Classification Search
CPC ..... A63B 41/08; A63B 41/085; A63B 41/10; A63B 43/002; A63B 43/00; A63B 2243/007
See application file for complete search history.

(56) References Cited

U.S. PATENT DOCUMENTS 1,187,029 A * 6/1916 Beebout ..... A63B 41/08 156/213
1,487,658 A 3/1924 Jensen
1,559,117 A 10/1925 Maynard
1,604,044 A * 10/1926 Hart ..... A63B 41/08 473/607
1,923,236 A * 8/1933 Sonnett ..... A63B 41/08 473/599
1,931,429 A 10/1933 Buckner et al.
2,011,760 A 8/1935 Gallinant
2,129,238 A * 9/1938 Riddell ..... 156/147
2,182,053 A 12/1939 Reach
2,194,674 A * 3/1940 Riddell ..... A63B 41/08 473/597
2,325,128 A 7/1943 Grady
2,448,731 A 9/1948 Park
2,627,892 A 2/1953 Fenton
2,653,818 A * 9/1953 Tebbetts, Jr. ..... A63B 39/00 428/161
2,931,653 A 4/1960 Gow
3,091,562 A 5/1963 Berlepsch, Jr. et al.
3,119,618 A * 1/1964 Molitor ..... A63B 41/00 273/DIG. 8

(Continued)

*Primary Examiner* — Steven Wong
(74) *Attorney, Agent, or Firm* — Law Office of William Gustavson, PC

(57) ABSTRACT

The sports ball (410) has an inner layer (416) and an outer panel (414). The inner layer (416) is secured to the outer panel (414) and several inner layers (416) and outer panels (414) are sewn together to form the sports ball (410). A strip (440) is positioned between the inner layer (416) and outer panel (414) under a white stripe (448) to raise the white stripe (448) on the sports ball (410) above the surrounding outer surface of the sports ball (410) to enhance grip. The sports ball (410) can be a football (412). A line of thread (424) can be stitched between the inner layer (416) and outer panel (414) on either side of the stripe (448) to enhance the shape retention of the sports ball (410), enhance grip and help keep the strip (440) in place. In a modification, a strip (480) is positioned between the inner layer (416) and outer panel (414) except under the white stripe (448) to form a void under the stripe (448) and enhance grip.

6 Claims, 12 Drawing Sheets

(56) References Cited

U.S. PATENT DOCUMENTS 3,256,019 A * 6/1966 Barton ..... A63B 37/0097 156/170
3,370,851 A 2/1968 Murray
3,863,923 A 2/1975 Anderson
3,917,271 A 11/1975 Lemelson et al.
3,948,518 A 4/1976 Tebbetts, Jr.
3,953,030 A 4/1976 Muchnick
4,000,894 A 1/1977 Butzen
4,053,676 A 10/1977 Kaminstein
4,071,374 A 1/1978 Minton
4,093,219 A 6/1978 Piraud
4,337,944 A 7/1982 Massino
4,346,890 A 8/1982 Kaminstein
4,462,590 A * 7/1984 Mitchell ..... A63B 41/08 273/DIG. 8
4,515,852 A 5/1985 Katabe et al.
4,536,413 A 8/1985 Powell
4,660,831 A * 4/1987 Kralik ..... A63B 41/00 473/603
4,822,041 A 4/1989 Molitor
4,867,452 A 9/1989 Finley
4,869,504 A 9/1989 Kralik
4,928,962 A 5/1990 Finley
5,040,795 A 8/1991 Sonntag
5,069,935 A 12/1991 Walters
5,098,097 A 3/1992 Kennedy et al.
5,127,648 A 7/1992 Mallick
5,133,550 A 7/1992 Handy
5,183,263 A 2/1993 Kuebler
5,195,745 A 3/1993 Rudell et al.
5,204,088 A 4/1993 Noebel et al.
5,228,687 A 7/1993 Luecke et al.
5,310,178 A 5/1994 Walker et al.
5,316,294 A 5/1994 Turangan
5,320,345 A 6/1994 Lai et al.
5,354,053 A 10/1994 Ratner et al.
5,383,660 A 1/1995 Adler et al.
5,427,372 A 6/1995 Ratner et al.
5,433,438 A 7/1995 Gilman
5,451,046 A 9/1995 Batton
5,570,882 A 11/1996 Horkan
5,577,724 A 11/1996 Gandolfo
5,669,838 A 9/1997 Kennedy et al.
5,681,233 A 10/1997 Guenther et al.
5,752,890 A 5/1998 Shishido et al.
5,779,578 A 7/1998 Calandro
5,851,161 A 12/1998 Sassak
5,865,697 A * 2/1999 Molitor ..... A63B 41/00 473/604
5,886,089 A 3/1999 Knowlton
5,888,157 A 3/1999 Guenther et al.
5,896,230 A 4/1999 Goggins
5,931,752 A 8/1999 Guenther et al.
5,941,785 A 8/1999 Bartels
5,984,812 A 11/1999 Sassak
5,997,422 A * 12/1999 Cooper ..... A63B 41/08 473/599
6,024,661 A 2/2000 Guenther et al.
6,123,632 A 9/2000 Feeney et al.
6,190,273 B1 2/2001 Maxey
6,200,239 B1 3/2001 Kennedy et al.
6,283,881 B1 9/2001 Feeney
6,331,151 B2 12/2001 Calandro
6,348,018 B1 * 2/2002 Ou ..... A63B 41/08 473/143
6,369,125 B1 4/2002 Nesbitt
6,500,082 B1 12/2002 Ou
6,514,164 B1 2/2003 Parrett
6,520,877 B1 2/2003 Yang
6,612,948 B1 9/2003 Miller
6,634,970 B2 10/2003 Jiminez
6,722,889 B1 4/2004 Page et al.
6,726,582 B1 4/2004 Kuo et al.
6,726,583 B1 * 4/2004 Lai ..... A63B 41/10 473/599
6,770,324 B2 8/2004 Hooker
6,787,582 B2 9/2004 Nesbitt
D505,462 S 5/2005 Horkan et al.
D505,463 S 5/2005 Horkan et al.
6,904,615 B2 6/2005 Kobe et al.
6,971,965 B1 * 12/2005 Shishido ..... A63B 41/08 473/604
6,997,830 B2 2/2006 Lin
7,029,407 B2 4/2006 Lee et al.
7,148,266 B2 12/2006 Nesbitt et al.
D544,052 S 6/2007 Krysiak
D544,053 S 6/2007 Krysiak
7,258,909 B2 8/2007 Akamata et al.
7,470,203 B1 12/2008 Stillinger
7,566,488 B2 7/2009 Mimura et al.
7,585,236 B2 9/2009 Krysiak
7,758,458 B2 7/2010 Fujisawa et al.
7,892,120 B2 2/2011 Krysiak
7,909,715 B2 3/2011 Krysiak
8,047,937 B2 * 11/2011 Krysiak ..... A63B 41/08 473/597
8,092,324 B2 1/2012 Ashida et al.
8,133,570 B2 3/2012 Fujisawa et al.
8,142,311 B2 3/2012 Krysiak
8,152,664 B2 4/2012 Madore et al.
8,168,026 B1 5/2012 Brown et al.
8,192,311 B2 6/2012 White et al.
8,251,846 B2 8/2012 Krysiak
8,460,135 B2 6/2013 Guenther et al.
8,460,136 B2 6/2013 Krysiak
8,579,742 B2 11/2013 Krysiak
8,740,734 B2 6/2014 Krysiak
9,084,918 B2 7/2015 McNamee
9,089,740 B2 * 7/2015 Frank ..... A63B 43/002
2004/0115376 A1 6/2004 Tomczyk
2004/0121865 A1 * 6/2004 Lee ..... A63B 41/08 473/597
2005/0221925 A1 10/2005 Dubow et al.
2006/0046880 A1 * 3/2006 Tang ..... A63B 41/08 473/604
2006/0293132 A1 12/2006 Laliberty et al.
2007/0129188 A1 6/2007 Maziarz et al.
2007/0178997 A1 8/2007 Chang
2009/0137352 A1 5/2009 Ou
2010/0248873 A1 * 9/2010 Cooper ..... A63B 41/08 473/599
2012/0028003 A1 2/2012 Abrams
2013/0231206 A1 9/2013 Guenther et al.
2014/0213396 A1 * 7/2014 McNamee ..... A63B 41/08 473/603
2014/0243124 A1 * 8/2014 McNamee ..... A63B 41/08 473/603
2015/0045159 A1 2/2015 Tompkins

* cited by examiner

TEXTURED SPORTS BALL

CROSS-REFERENCE TO RELATED APPLICATIONS

This application is a Continuation-in-Part of pending U.S. patent application Ser. No. 14/471,066 filed Aug. 28, 2014.

TECHNICAL FIELD

This invention relates to sport balls such as footballs and basketballs, and in particular to the surface texture thereof.

BACKGROUND OF THE INVENTION

The outermost surface or covers of various sports balls, such as footballs and basketballs, are textured with protrusions or pebbles which are designed to create more friction and thus improve the gripability of the ball by the hands of the players using them. Most players consider grip to be a key element of their success. In general, the worse the grip of the sports balls, the worse the ball is believed to perform. When players of basketball and football in particular are unable to control and grip the ball, the result is usually believed to be bad for the player and the team in possession of the ball. Footballs and basketballs have a surface textured with protrusions or pebbles which are designed to create more friction and thus improve the grip. The pebbles typically have a circular, dome or semi-spherical shape with a width of approximately 3/32 inch (0.09375") wide and a height of approximately 1/32 inch (0.03125") high. Each pebble is usually wider than it is tall by a ratio of about 3:1. However, a need continues to exist to improve the grip of a sports ball to allow the player to better play the game.

SUMMARY OF THE INVENTION

In accordance with one aspect of the present invention, a sports ball has pebbles on its outer surface with each pebble having a width of about 1/4 inch. In accordance with another aspect of the present invention, the width to height ratio of the pebble is about 4:1. In accordance with another aspect of the present invention, the width is in a range from about 1/8 inch to 3/8 inch to provide a width to height ratio of the pebbles in the range from about 2:1 to 6:1 for a 1/16 inch height.

In accordance with another aspect of the present invention, the density of the pebbles on the outer surface is at least 2 pebbles per square inch and preferably in a range of about 4-10 pebbles per square inch, and preferably about 6 pebbles per square inch.

In accordance with another aspect of the present invention, a sports ball has at least one inner layer and at least one outer panel, the inner layer and outer panel being attached by sewing, gluing or laminating together at their edges. The inner layer has a protruding line along the edge of the inner layer. The line can be created by sewn thread, printing, embroidery, glue or many other methods using a variety of materials or may be suspended by friction or even attached to the inside of the outer panel. The thread or other material on the inner layer causes the outer panel to bulge slightly outward proximate the attachment between the inner layer and outer panel when attached to enhance grip of the sports ball. In accordance with another aspect of the present invention, the inner layer can have a protruding line to raise a logo or stripe on the outer panel.

In accordance with another aspect of the present invention, a sports ball has at least one inner layer and at least one outer panel, the inner layer and outer panel being attached by sewing, gluing or laminating together at at least their edges. The inner layer has protrusions formed thereon. The protrusions raise a portion of the outer panel. In one embodiment, the protrusions are directly below the pebbles on the outer panel, which supports and/or raises the pebbles relative to the surrounding outer surface of the outer panel, which provides an enhanced appearance and/or grip. In another embodiment, at least one protrusion is directly below a logo or white stripe formed on the outer panel which raises the logo or white stripe slightly relative to the surrounding outer surface of the outer panel to enhance appearance and/or grip.

In accordance with another aspect of the present invention, the sports ball has an inner layer and an outer panel. The inner layer is secured to the outer panel and several inner layers and outer panels are sewn together to form the sports ball. A strip is positioned between the inner layer and outer panel under a white stripe to raise the white stripe on the sports ball above the surrounding outer surface of the sports ball to enhance grip. The sports ball can be a football. A line of thread can be stitched between the inner layer and outer panel on either side of the stripe to enhance the shape retention of the sports ball and help keep the strip in place. In a modification, a strip is positioned between the inner layer and outer panel except under the white stripe to form a void under the stripe and enhance grip.

In accordance with another aspect of the present invention, the sports ball is a football.

BRIEF DESCRIPTION OF THE DRAWINGS

A more complete understanding of the invention and its advantages will be apparent from the following Detailed Description, taken in conjunction with the accompanying Drawings, in which.

DETAILED DESCRIPTION

Figure 1:
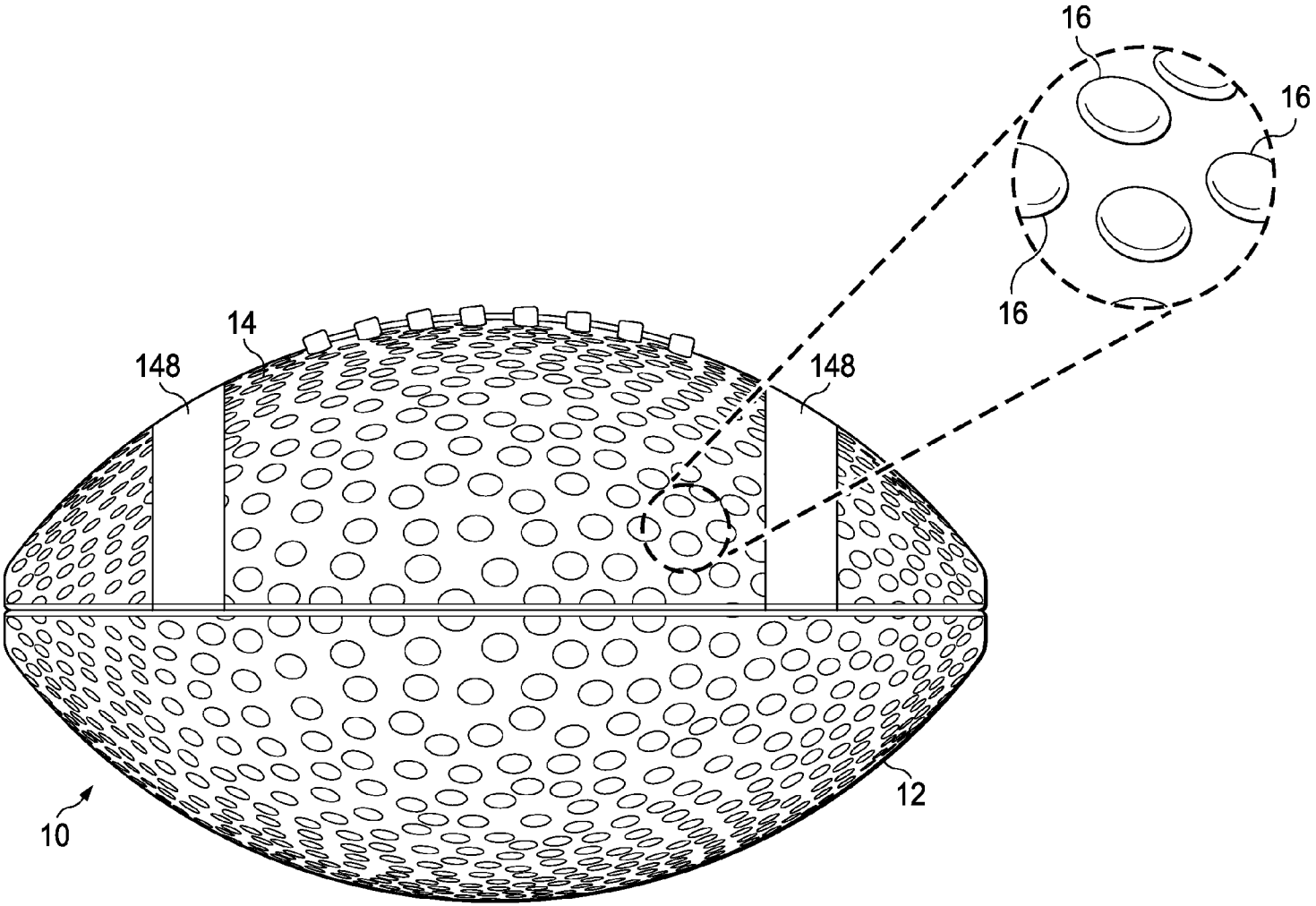
FIG. 1 is an illustration of a sports ball forming a first embodiment of the present invention incorporating pebbles.

With reference now to the figures, FIG. 1 illustrates a sports ball 10, in this case a football 12. Sports ball 10 could as readily be a basketball, or other ball used in sport play. As can be seen, the sports ball 10 has an outer surface or cover 14 that is textured by outward protrusions or pebbles 16 on the surface 14. While the material of the cover 14, usually leather, rubber or materials with similar properties, has inherently good gripability, the use of pebbles 16 is intended to create enhanced friction and thus improve the gripability of the sports ball 10.

Figure 2A:
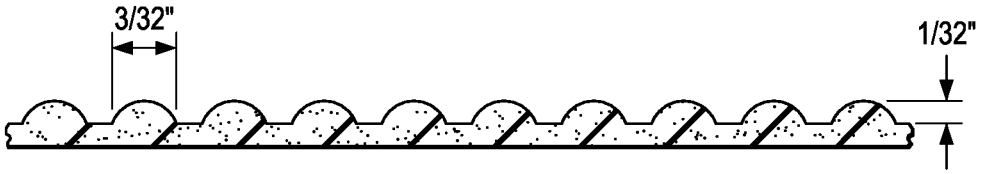
FIG. 2A (PRIOR ART)
FIG. 2A is an illustration of the prior art pebble dimensions.
Figure 2B:
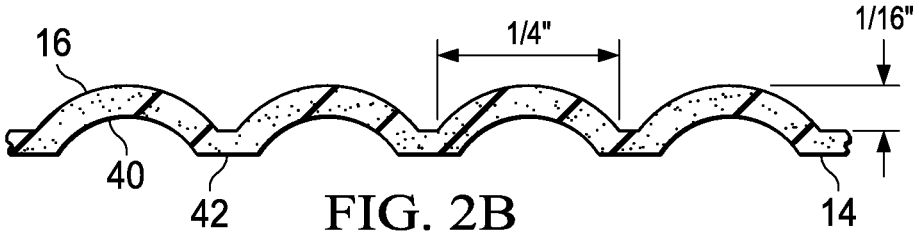
FIG. 2B is an illustration of the pebbles provided in accordance with a first embodiment of the present invention.

As noted previously, the conventional sports ball has pebbles approximately 3/32 inch (0.09375") wide and 1/32 inch (0.03125") high. Each pebble is thus wider than it is tall by a ratio of about 3:1. However, ball 10 of the present invention has pebbles 16 that are increased in width and height. Each pebble 16 has a width of approximately ¼ inch (0.25"). The pebbles 16 have a height of approximately 1/16 inch (0.0625") so that the pebbles 16 have a width to height ratio of approximately 4:1. A comparison of the conventional pebbles and pebbles of the present invention is shown in FIGS. 2A and 2B.

The typical conventional sports ball pebble and the pebbles 16 are typically a basically circular shape in cross section parallel the surface 14 of the ball 10, so that each pebble forms a dome or semi-spherical shape. The width is thus defined as the diameter of the circular cross-section of the conventional pebble or pebble 16 at the surface 14. However, the pebbles 16 can have any other configuration, such as a cube shape or pyramid shape with a square cross-section, or triangular cross section, or other shapes which may improve friction or grip. In such a configuration, the width of ¼ inch would be an average dimension of the pebble 16 in the plane of the surface 14. For example, for a pebble 16 of cube shape, with a square cross-section in the plane of the surface 14, the length of a side of the cube, the length of the diagonal between opposite edges of the cube or the diameter of a hemisphere having the same volume as the cube shape could be the width of the pebble 16 of cube shape. It is believed that this increase in the size, namely the width and height of the pebbles 16 over conventional pebble widths will increase the gripability of the sports ball 10 measurably.

Conventional sports balls have approximately 90-160 pebbles per square inch on its outer cover. However, the sports ball 10 has a decreased number of pebbles per square inch on the outer cover 14, which further increases the friction and significantly improves the grip of the sports ball 10. The sports ball 10 has at least approximately two pebbles 16 per square inch of the cover 14, and preferably within the range of about four to ten pebbles 16 per square inch, and even more preferably about six pebbles 16 per square inch. The pebbles 16 can be uniformly or randomly spaced over the surface of the cover 14. By use of pebbles 16 having a larger size than those used in conventional sports balls, the sports ball 10 has room to decrease the density per unit surface area of the pebbles 16 by twofold or more over conventional sports balls.

While the preferred width of pebbles 16 is about ¼ inch, it is believed that the advantages of the present invention in improving gripability can be realized by having the width of pebbles 16 in a range from about ⅛ inch to ⅜ inch. This provides a ratio of width to height of pebbles 16 in the range from about 2:1 to 6:1 with a height of about 1/16 inch. The pebbles 16 on sports ball 10 can all be of about the same width, for example ⅛ inch or ⅜ inch, or can be in a range of widths from ⅛ inch to ⅜ inch. Any distribution of different width pebbles can be used, with ½ of the pebbles 16 of width ⅛ inch and the other ½ of the pebbles 16 of width 5/16 inch, for example, or the widths varying uniformly between ⅛ inch diameter and ⅜ inch diameter, for example.

The pebbles 16 are preferably formed integral with the cover 14, which is commonly leather, by using a known embossing process of the type used to make a conventional pebbled football cover. In this process, the cover 14 would be pressed between two dies, the die contacting the inner surface of the cover 14 having raised pebbles and the die contacting the outer surface of the cover 14 having mating recesses so that when the cover 14 is pressed between the dies, the pebbles 16 are formed. This process will typically create a recess 40 in the inner surface 42 of the cover 14 associated with each pebble 16, as illustrated in FIG. 2B.

While a height of about 1/16 inch is believed most suitable for the pebbles 16, the height can be varied between about 1/32 inch to about 3/32 inch and remain effective.

Figure 4:
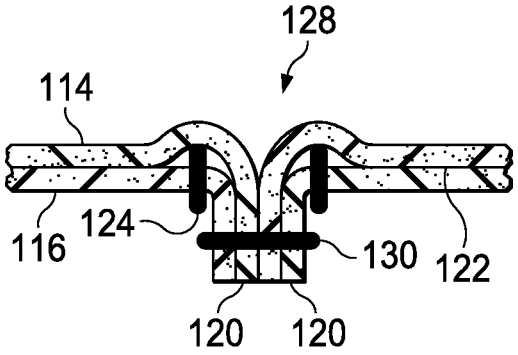
FIG. 4 is an illustration of the sports ball of FIG. 3 illustrating the raised seam to enhance grip.
Figure 3:
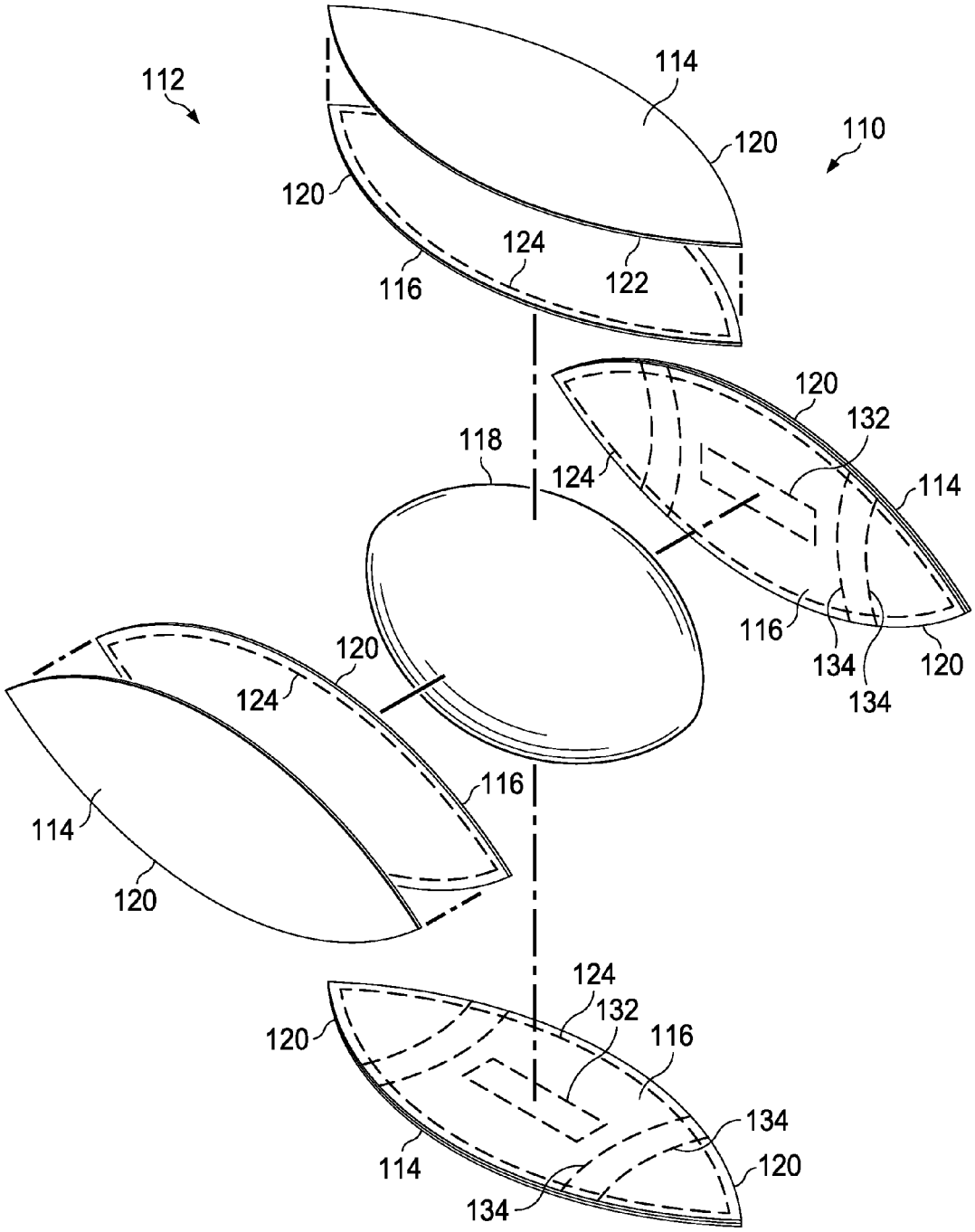
FIG. 3 is an exploded view of a sports ball incorporating a second embodiment of the present invention.

With reference now to FIGS. 3 and 4, a second embodiment of the present invention will be described. FIG. 3 illustrates a sports ball 110, in this case a football 112. Sports ball 110 could as readily be a basketball, or other ball used in sport play. Football 112 is formed of four outer leather or synthetic panels 114, four inner layers 116 of similar shape as the panels 114 and an air bladder 118. Each of the inner layers 116 is sewn, glued or laminated to the inside surface 122 of an outer panel 114. The inner layers 116 are generally the same shape and dimensions as the panels 114. The inner layers 116 are typically fabric reinforced by rubber, vinyl or polyurethane to add strength and weight to the football 12. The inner layers 116 and outer leather panels 114 are sewn together by thread 130 at their edges 120 to form the exterior of the football 112. The bladder 118 lies inside the football 112 and can be inflated to the desired air pressure for the football 112.

As seen in FIG. 3, each inner layer 116 has a thread 124 sewn through it proximate the peripheral edge 120 of the inner layer 116. When the inner layer 116 is attached to the outer panel 114, and the panels 114 and layers 116 are attached together at their edges 120 by thread 130, the threads 124 will raise the seam 128 formed between the panels 114 to enhance grip of the football 112, as seen in FIG. 4. The thickness of the thread 124 can be chosen to provide the desired rise of the seam 128. Also, multiple threads 124 can be sewn proximate the peripheral edge 120 to raise the seam 128 even more. Also, while thread 124 is shown, any suitable material that provides a protruding line of extra thickness proximate the peripheral edge 120 can be used as a substitute for the thread 124, such as a line of glue, rivets, staples, thick or puffy ink, embroidered or stitched material, shenille, corded material or the like.

Figure 7A:
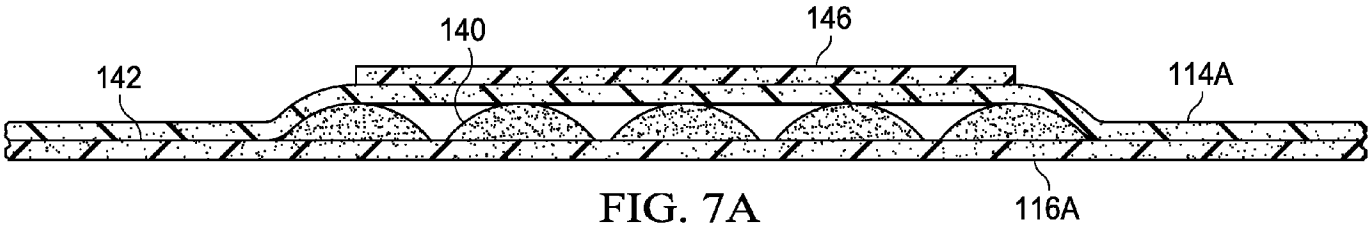
FIG. 7A is an illustration of the sports ball of FIG. 5 illustrating the raised logo using discrete protrusions.
Figure 7B:
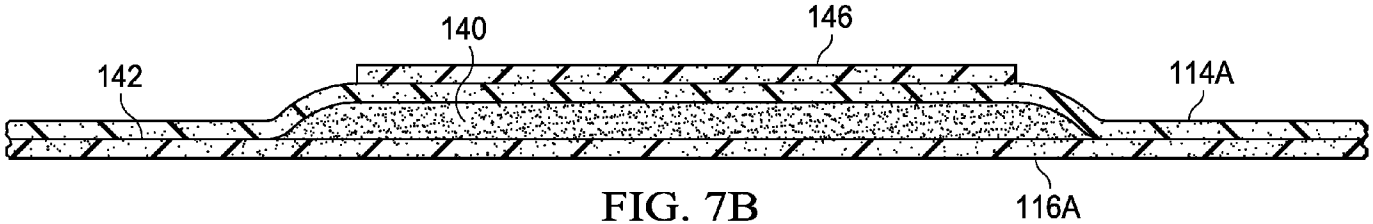
FIG. 7B is an illustration of the sports ball of FIG. 5 illustrating the raised logo using a single protrusion.

A logo 146, such as seen in FIGS. 7A and 7B, can be formed on the outer surface of one of more of the outer panels 114. A thread 132, as seen in FIG. 3, can be sewn through the inner layer 116 mating with the outer panel 114 having the logo 146 so that when the inner layer 116 is secured to the outer panel 114, the thread 132 is positioned underneath the perimeter of the logo 146 and acts to raise the logo 146 above the surrounding surface of the outer panel 114. Multiple threads 132 can be sewn underneath the logo 146, if desired. The same thread substitutes noted above with reference to thread 124 can be substituted for thread 132.

Figure 8A:
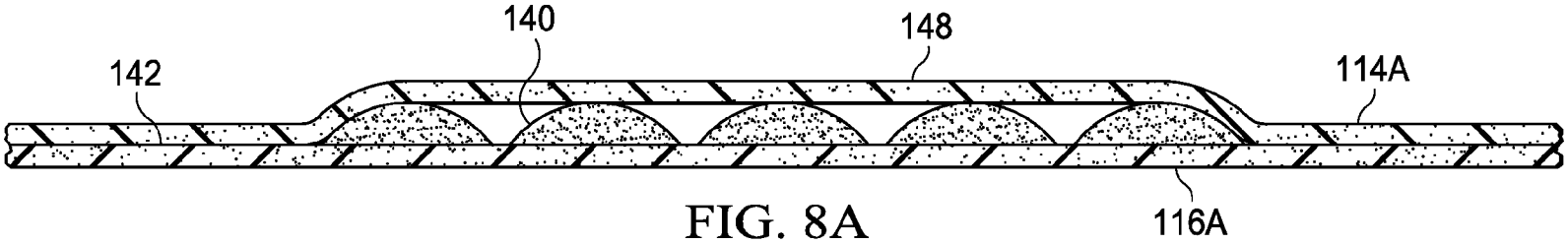
FIG. 8A is an illustration of the sports ball of FIG. 5 illustrating the raised white stripe on the sports ball using discrete protrusions.
Figure 8B:
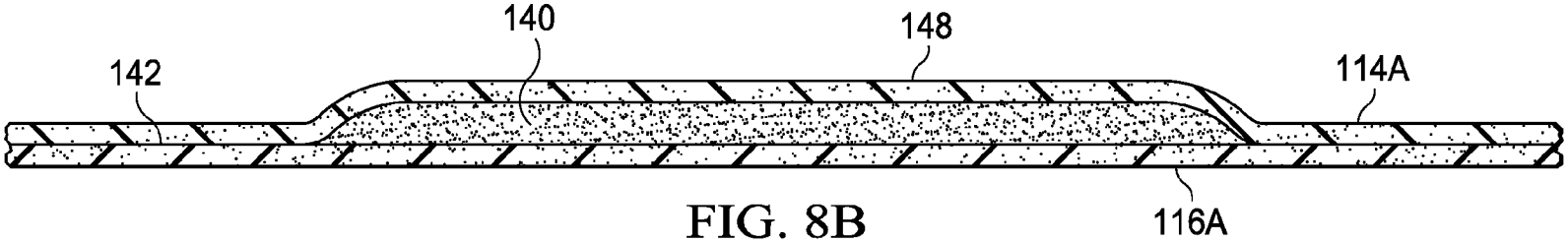
FIG. 8B is an illustration of the sports ball of FIG. 5 illustrating the raised white stripe on the sports ball using a single protrusion.

A white stripe 148, such as seen in FIGS. 1, 8A and 8B, can be formed on the outer surface of one of more of the outer panels 114. Parallel lines of thread 134, as seen in FIG. 3, can be sewn through the inner layer 116 mating with the outer panel 114 having the stripe 148 so that when the inner layer 116 is secured to the outer panel 114, the threads 134 are positioned underneath the edges of the stripe 148 and act to raise the stripe 148 above the surrounding surface of the outer panel 114. Multiple parallel lines of threads 134 can be sewn underneath the stripe 148, if desired. The same thread substitutes noted above with reference to thread 124 can be substituted for thread 134.

Thread 124, 132 or 134 could be used to raise other features on the outer surface of the sports ball 110 as well.

Figure 5:
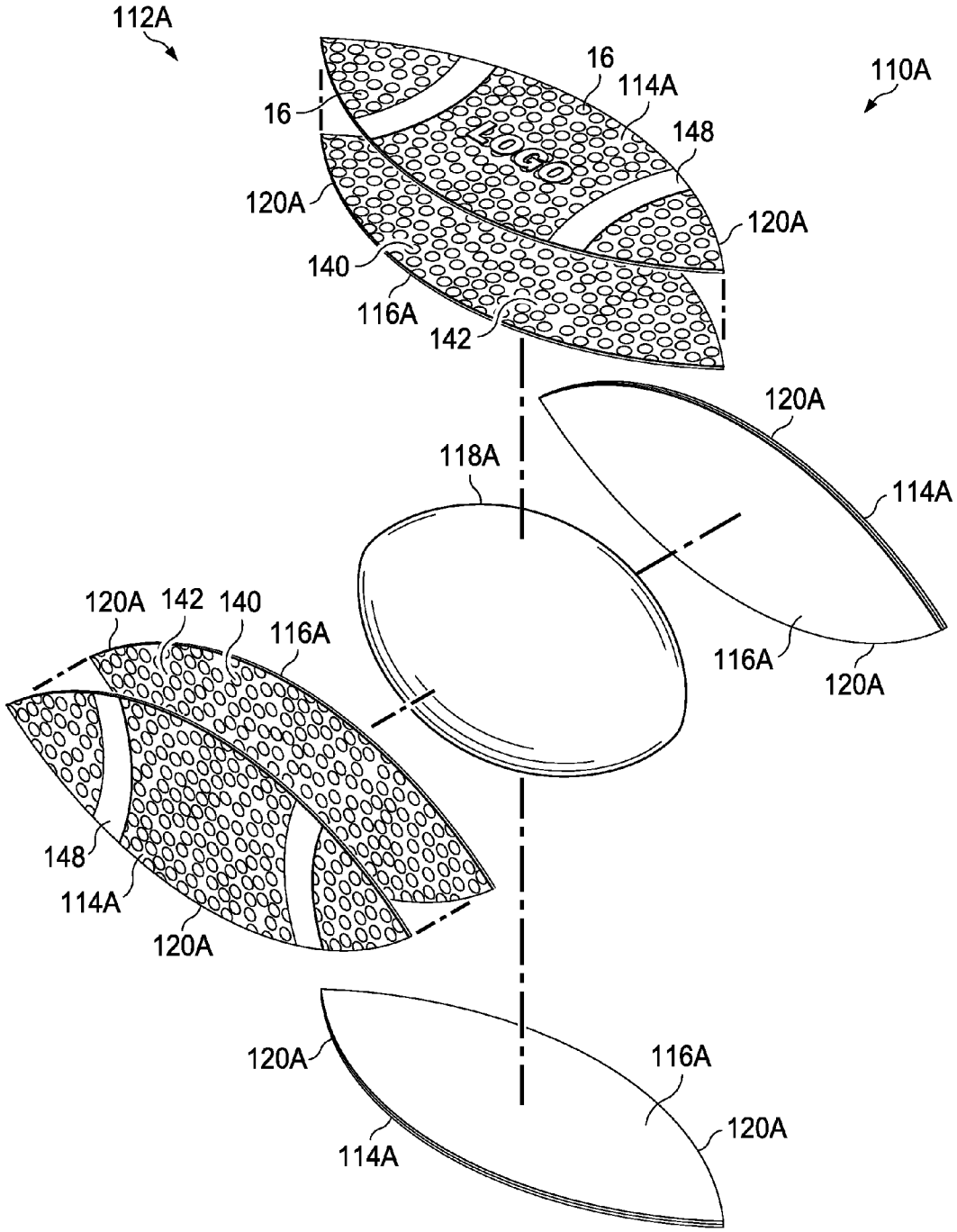
FIG. 5 is an exploded view of a sports ball incorporating a third embodiment of the present invention.
Figure 6:
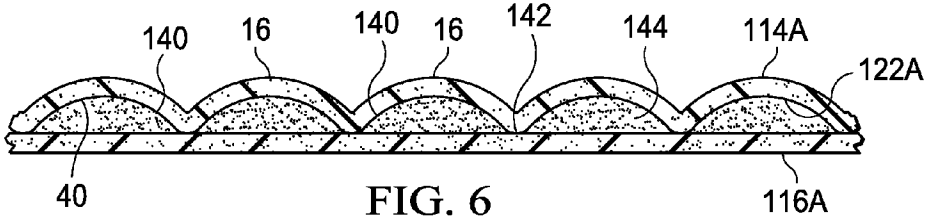
FIG. 6 is a detail view showing the protrusions on the inner layer.

With reference to FIGS. 5-8, a third embodiment of the present invention will be described. FIG. 5 illustrates a sports ball 110A, in this case a football 112A. Sports ball 110A could as readily be a basketball, or other ball used in sport play. Football 112A is formed of four outer leather panels 114A, four inner layers 116A of similar shape as the panels 114A and an air bladder 118A. Each of the inner layers 116A is sewn or glued to the inside surface 122A of an outer panel 114A. The inner layers 116A are generally the same shape and dimensions as the panels 114A. The inner layers 116A and outer leather panels 114A are sewn together at their edges 120A to form the exterior of the football 112A. The bladder 118A lies inside the football 112A and can be inflated to the desired air pressure for the football 112A. Preferably, the outer panels 114A have pebbles 16 as described above with reference to sports ball 10. Further, each of the inner layers 116A has a series of protrusions 140 on the outer surface 142 thereof. The protrusions 140 can be ink 144 printed onto the surface 142 of the inner layers 116, for example, as seen in FIG. 6.

Preferably, the protrusions 140 are in alignment with pebbles 16 on the outer panels 114A, as seen in FIG. 6, so that each of the protrusions 140 fills or partly fills the recess 40 of the pebble 16 it is associated with to support and/or raise the pebble 16. However, protrusions 140 can be utilized without the outer panels 114A having pebbles 16 or some or all of the protrusions 140 may not be in alignment with pebbles 16 on the outer panels 114A. For example, protrusions 140 can be distributed uniformly over the outer surface 142 of the inner layers 116A. This would provide raised portions uniformly distributed about the outer panels 114A to enhance grip. Protrusions 140 could also be formed on the inner surface 122A of outer panels 114A to supplement protrusions 140 on the inner layers 116A or in a sports ball 110A having no protrusions 140 on the inner layers 116A.

The protrusions 140 are typically a basically circular shape in cross section parallel the surface 142 of the inner layer 116A, so that each protrusion 140 forms a dome or semi-spherical shape. The width is thus defined as the diameter of the circular cross-section of the protrusion 140 at the surface 142. However, the protrusions 140 can have any other configuration desired, such as the configurations described above for pebbles 16. The protrusions 140 can extend outwardly from the surface 142 to a height in the range from about 1/32 inch to about 3/32 inch, and preferably of about 1/16 inch. The protrusions 140 can have a width where the protrusions 140 intersect the surface 142 in the range from about 1/16 inch to about 5/16 inch. Typically, when a protrusion 140 is associated with a pebble 16 on outer panel 114A, the dimensions of the protrusion 140 will be about the same as the dimensions of the pebble 16 it is aligned with.

As seen in FIGS. 7A and 7B, one of the outer panels 114A may have a logo 146 formed on its exterior surface. If a series of protrusions 140 are formed on the outer surface 142 of the inner layer 116A just underneath the logo 146, the logo 146 will be slightly raised relative to the surrounding surface of the outer panel 114A as seen in FIG. 7A. As seen in FIG. 7B, the series of protrusions 140 can be replaced by a single protrusion 140 with dimensions similar to the logo 146. Not only does this enhance the visibility of the logo 146, but it provides a better grip of the football 112A.

As seen in FIGS. 8A and 8B, many footballs 112A have white stripes 148 formed on the outer surface of the outer panels 114A. These stripes 148 can be raised slightly above the surrounding surface of the outer panels 114A to enhance grip. However, by placing a series of protrusions 140 on the outer surface 142 of the inner layers 116A just beneath the white stripes 148, as seen in FIG. 8A, the white stripes will be additionally raised relative the surrounding surface of the outer panels 114A to further enhance the grip. As seen in FIG. 8B, the series of protrusions 140 can be replaced by a single protrusion 140 with dimensions similar to the stripe 148. Raising the stripes 148 also provides a better grip of the football 112A.

Figure 9:
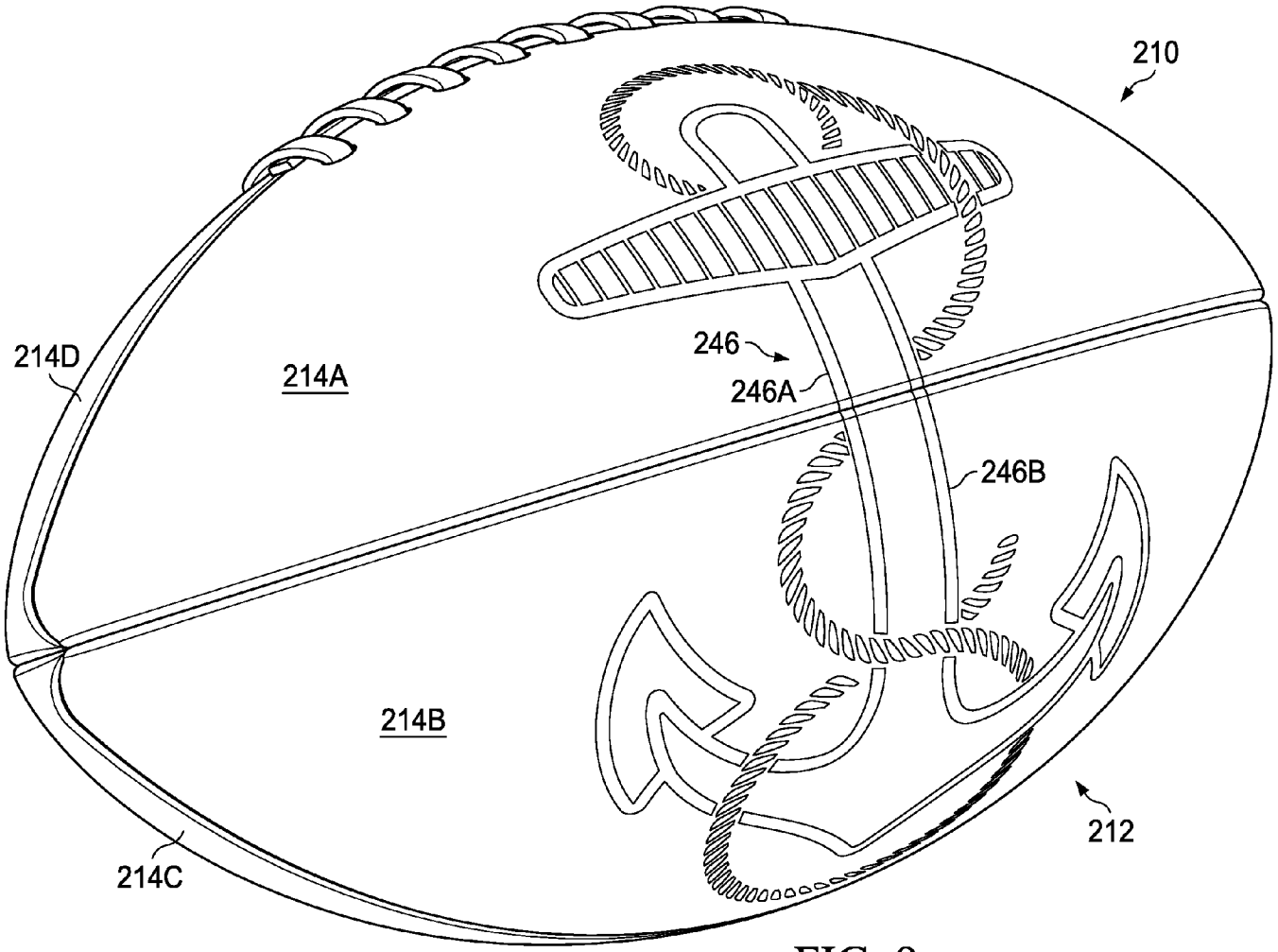
FIG. 9 is an illustration of a sports ball having a logo over multiple panels of the sports ball.
Figure 10:
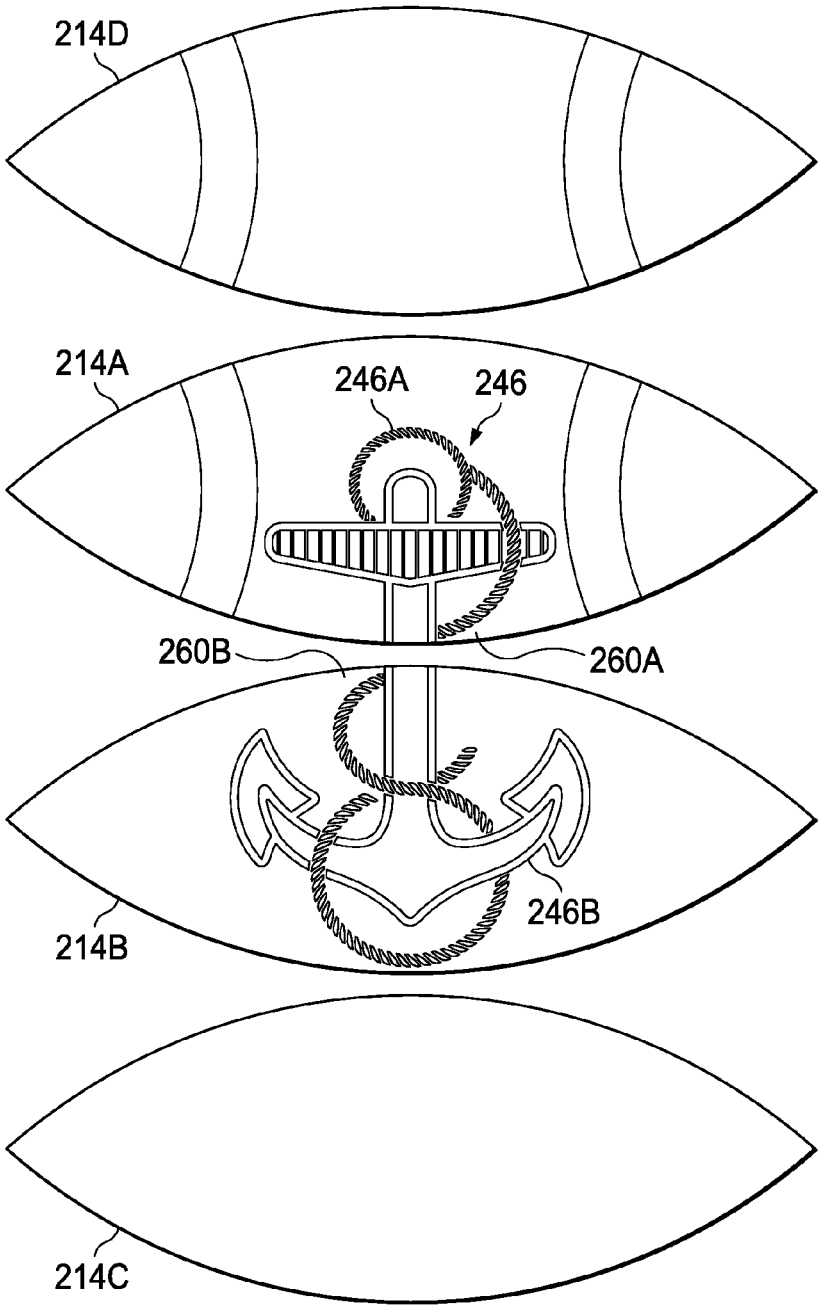
FIG. 10 is a layout view of the panels forming the sports ball of FIG. 9 showing the logo formed on multiple panels.

With reference now to FIGS. 9 and 10, a fourth embodiment of the present invention will be described. FIG. 9 illustrates a sports ball 210, in this case a football 212. Sports ball 210 could as readily be a basketball, or other ball used in sport play. Football 212 is formed of four outer leather or synthetic panels 214A, 214B, 214C and 214D sewn together to form the exterior of the football 212, with an inflated bladder therein. The construction of football 212 can be the same as any of the footballs 12, 112 or 112A above.

A logo 246 is formed on two panels 214A and 214B as shown in FIG. 9. The logo 246 is formed in two separate parts, logo 246A on panel 214A and logo 246B on panel 214B. However, when the football 212 is constructed and the bladder therein inflated to the desired air pressure, the logo 246 appears as a single unitary logo. It may be necessary to slightly distort the image of logo 246A and 246B in the areas 260A and 260B near the joined edges of the panels 214A and 214B when the panels 214A and 214B are flattened, as shown in FIG. 10, before they are sewn together and the bladder inflated to form the finished football 212. In this manner the image of the logo 246 looks perfectly symmetrical when the football 212 is inflated. It is also possible to have the logo 246 extend over more than two of the panels. For example the logo 246 can extend over three panels or all four panels.

The logo 246 can be formed on the panels 214A and 214B by any known method of logo application, such as hot foil stamping, heat transfer, gluing, heat bonding, sewing and the like.

Figure 11:
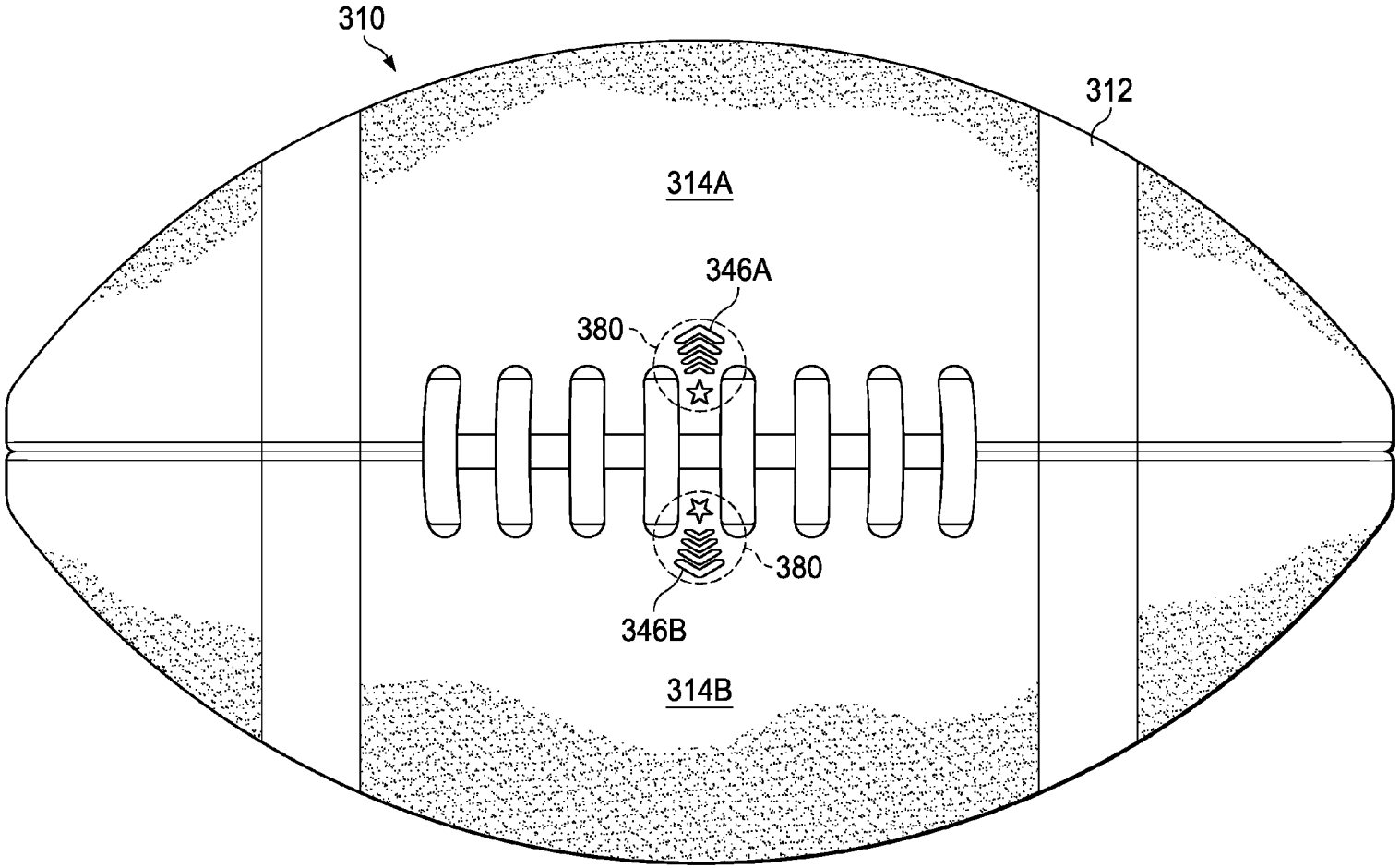
FIG. 11 is an illustration of a sports ball having a locator logo for identifying the position of a microcircuit such as a near field communication device or NFC or RFID device mounted within the sports ball.
Figure 12:
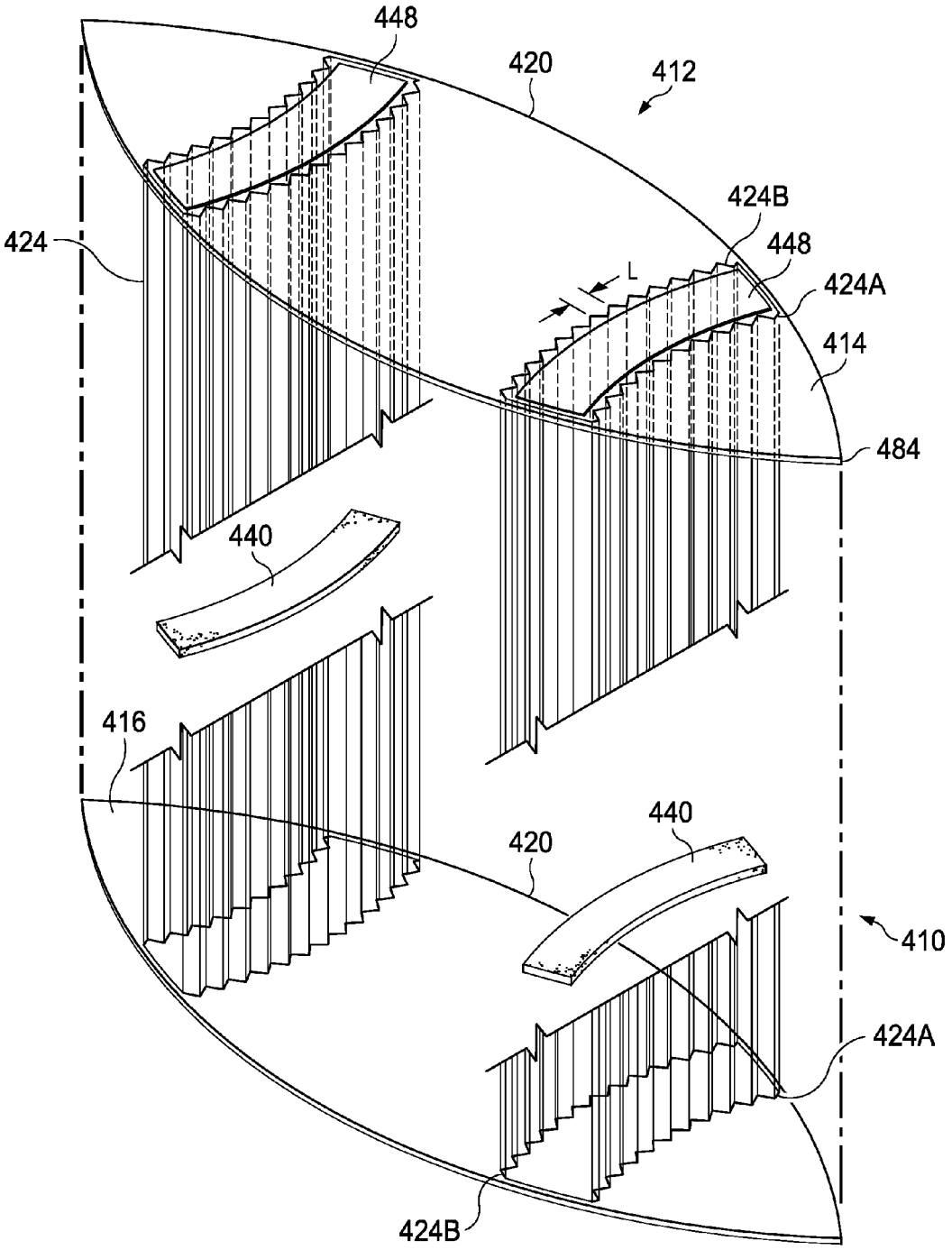
FIG. 12 is an exploded view of a sports ball incorporating a sixth embodiment of the present invention.

With reference now to FIG. 11, a fifth embodiment of the present invention will be described. FIG. 11 illustrates a sports ball 310, in this case a football 312. Sports ball 310 could as readily be a basketball, or other ball used in sport play. Football 312 is formed of four outer leather or synthetic panels 314A, 314B, 314C (not shown) and 314D (not shown) sewn together to form the exterior of the football 312, with an inflated bladder therein. The construction of football 312 can be the same as any of the footballs 12, 112, 112A or 212 above.

On panels 314A and 314B are formed locator logos 346A and 346B, respectively. It is becoming common practice to embed a microcircuit or chip 380, such as an identification chip or chip that provides other benefits, inside a game ball such as football 312 to provide a unique identifier or other benefit for that game ball. However, since the chip 380 is located inside the game ball, it is necessary for the person scanning the chip 380 to know exactly where the chip 380 is mounted within the ball to be able to use the scanner designed to interact with the chip 380, as the scanner usually must be quite close physically to operate properly. Football 312 has the advantage of mounting the chip 380 near the locator logos 346A and 346B so that the user can immediately identify the location to be scanned on the football 312. Two chips 380 are used in the football 312 shown, but a single chip 380 may be all that is needed. The chips 380 can be near field communication or NFC technology for short range contactless communications based on radio frequency identification (RFID) standards.

With reference to FIGS. 12-15, a sixth embodiment of the present invention will be described. FIGS. 12-15 illustrate sections of a sports ball 410, in this case a football 412. Sports ball 410 could as readily be a basketball, or other ball used in sport play. Football 412 is formed of four outer leather panels 414 (only one of which is shown), four inner layers 416 (only one of which is shown) of similar shape as the panels 414 and an air bladder (not shown). Each of the inner layers 416 is sewn or glued to the inside surface of an outer panel 414. The inner layers 416 are generally the same shape and dimensions as the panels 414. The inner layers 416 and outer leather panels 414 are sewn together at their edges 420 to form the exterior of the football 412. The bladder lies inside the football 412 and can be inflated to the desired air pressure for the football 412. The outer panel 414 shown in FIGS. 12-15 has two white stripes 448 affixed thereto. Typically, the two panels 414 on either side of the laces of the football will have two such stripes while the other two panels 414 have no stripes at all to conform with existing rules of certain football leagues. However, stripes 448 can be provided on all panels 414 if desired. Other than as discussed below, the construction of sports ball 410 can be identical to any of the sports balls 10, 110, 110A, 210 and 310 described above.

Figure 13:
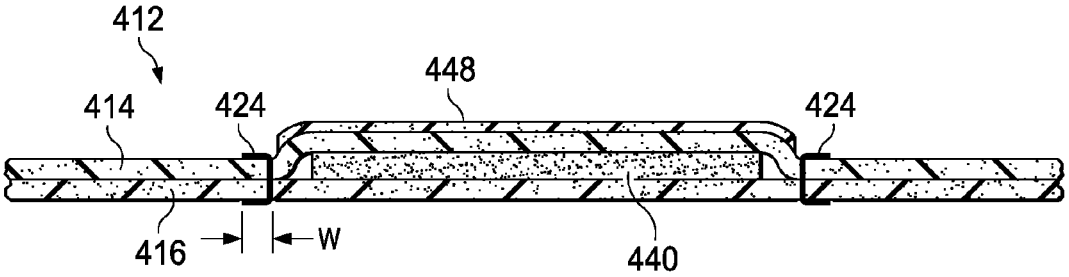
FIG. 13 is a cross-section of the sports ball of FIG. 12.
Figure 14:
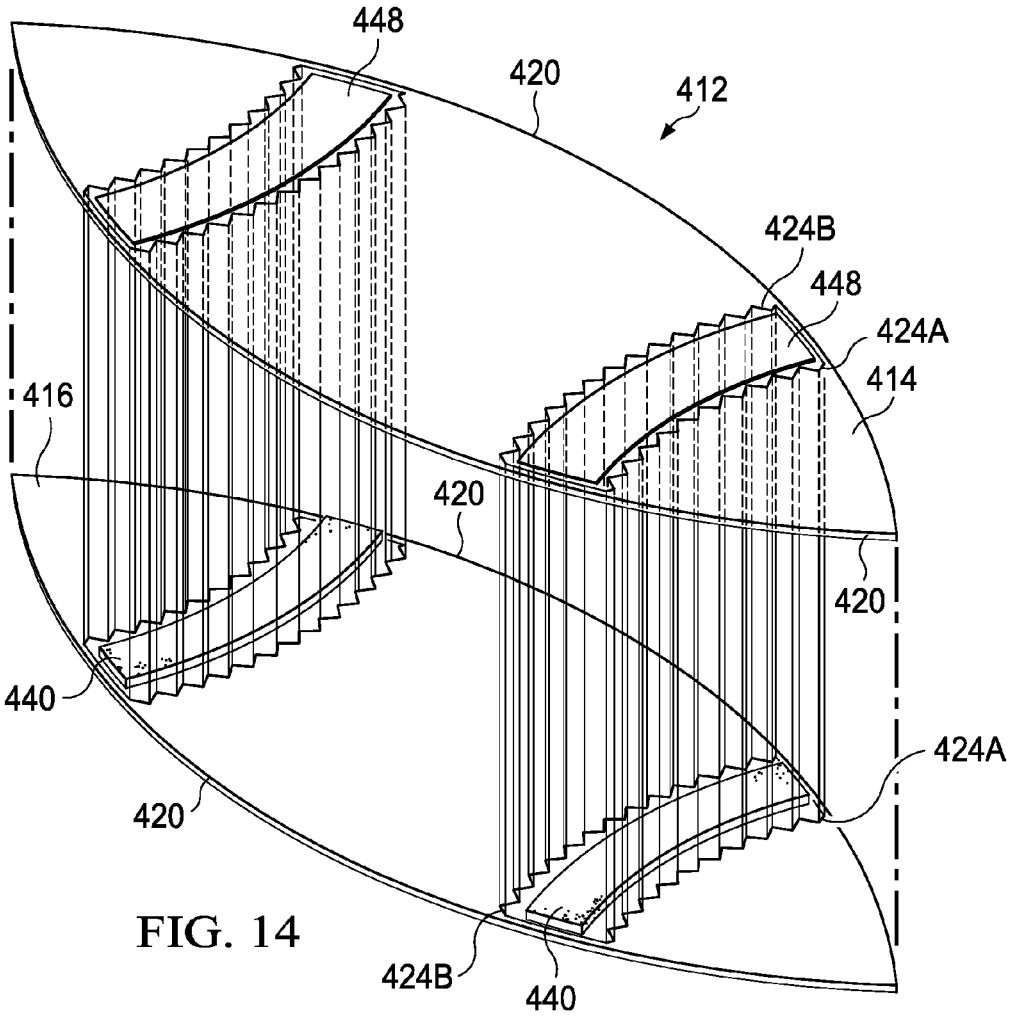
FIG. 14 is an exploded view of the sports ball of FIG. 12.

In sports ball 410, the single protrusion 140 is formed by a single strip 440 of open or closed cell foam or other suitable material such as leather, rubber, plastic or ink or other suitable materials, having an uncompressed thickness of about 1/32 inch to 1/4 inch. When the sports ball 410 is assembled and inflated, the strip 440 will force the area of the outer panel 414 on which the stripe 448 is fixed to rise above the surrounding surface of the outer panel 414, as best seen in FIG. 13. The white stripe 448 can protrude about 1/16 inch to 1/8 inch above the surrounding surface, for example. A typical white stripe 448 is about 3.75 inches long between the edges 420 and about 1 inch wide. Under rules promulgated by certain football leagues, the edge of stripes 448 closest to proximate end 484 of the football will be 3 inches to 3 1/4 inches from the proximate end 484 measured along the surface of the football when inflated. The strip 440 preferably would have slightly smaller width and length dimensions than stripe 448 to prevent interference with stitching between panels 414. The strip 440 could be adhesively tacked in place to either the outer panel 414 and/or inner layer 416 to aid in assembling the football 412. The protrusion of the stripe 448 improves grip on the ball 410. Moreover, the softness or compressibility of the underlying strip 440 will also improve grip as the strip 440 will compress somewhat as a player's fingers contact the stripe 448, depressing the stripe 448 somewhat to cradle the player's fingers and enhance grip.

Figure 15:
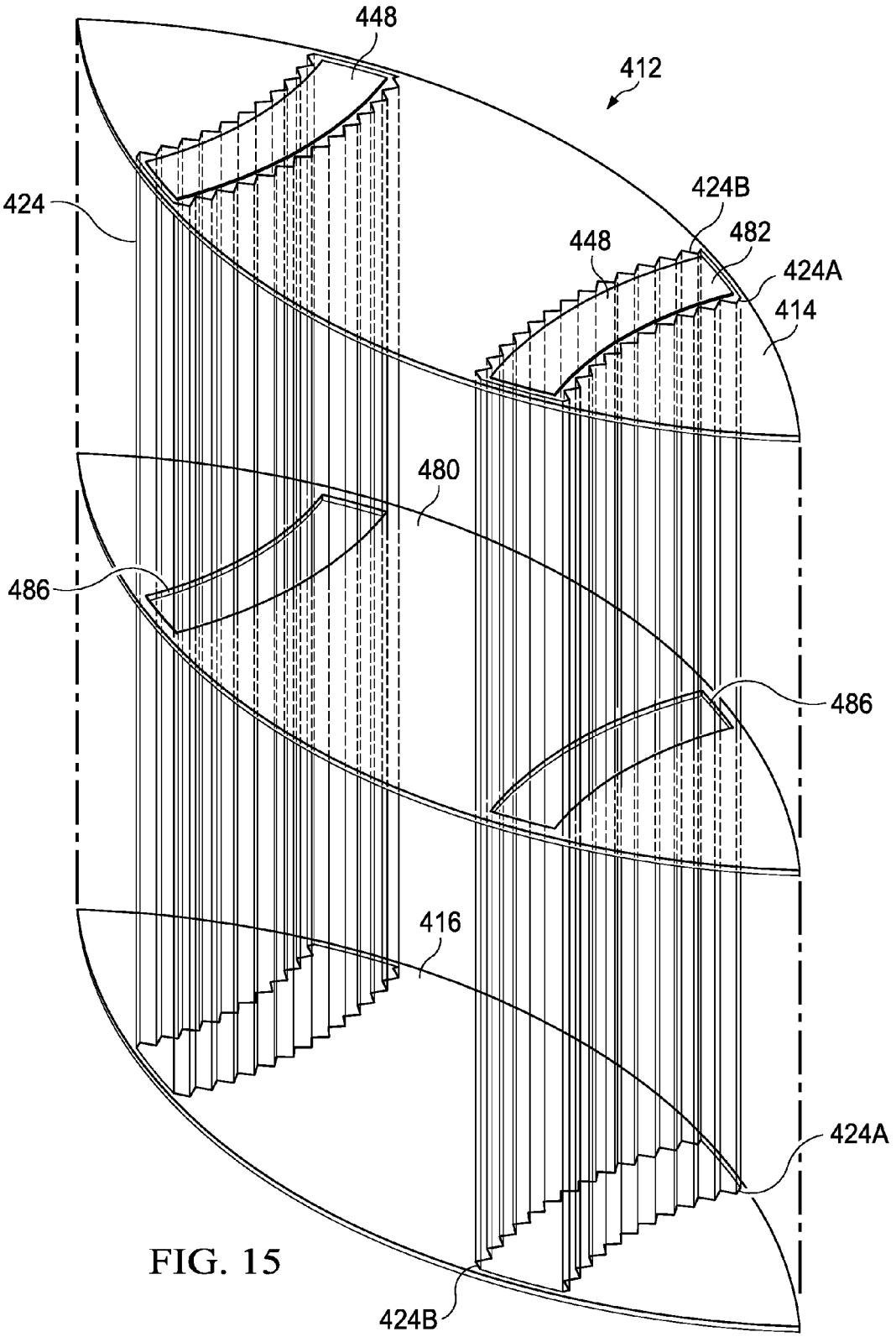
FIG. 15 is an exploded view of a modification to the sports ball of FIG. 12.

In an alternative construction, as seen in FIG. 15, the two strips 440 used with each outer panel 414 and mating inner layer 416 having stripes 448 can be substituted for by a single strip 480 with stripe shaped cutouts 486. Strip 480 lies between outer panel 414 and inner layer 416 except under the stripes 448. The cutouts 486 are approximately the same dimensions as the white stripes 448 and the cutouts 486 lie directly below the white stripes 448. Strip 480 can be formed of open or closed cell foam or other suitable material such as leather or ink having an uncompressed thickness of about 1/32 inch to 1/4 inch. This will leave a slight void under the portion 482 of outer panel 414 on which the stripe 448 is secured which improves grip. When the fingers of the player contact the portion 482 and stripe 448, the portion 482 and stripe 448 are slightly depressed into the void to cup about the fingers and improve grip. The only voids between outer panel 414 and inner layer 416 can be those created by strip 480 at the cutouts 486, if desired.

Also in sports ball 410 are lines of thread 424 stitched through both the outer panel 414 and the inner layer 416 as seen in FIG. 13. The lines of thread 424 preferably run on either side of the white stripes 448 continuously between the edges 420. The lines of thread 424, being stitched through both outer panel 414 and inner layer 416, enhance the shape retention of the sports ball 410. While the lines of thread 424 are preferably run just outside the edges of the white stripes 448, they could be stitched partially into or entirely through the white stripes 448 as well. Additionally, the lines of thread 424 could be stitched between the outer panel 414 and inner layer 416 anywhere between the edges 420. While four lines of thread 424 are shown in the Figures as stitched through each outer panel 414 and inner layer 416, one on each side of the two white stripes 448, any number of lines of thread 424 could be used. In addition to shape retention, the thread 424 helps keep the strip 440 in place beneath the stripe 448, both during manufacture and use. In one construction made in accordance with the present invention, the width W of the thread stitch is 1/8 inch or about 1/8 inch. The length L of the stitch is 1/9 to 1/10 of an inch or about 1/9 to about 1/10 of an inch, leading to 9 to 10 thread stitches per inch or about 9 to about 10 thread stitches per inch. The thread is preferably bonded Anefil Nylon material with a gauge of 135 and listed as 16 ounce. If the proximate edge of white stripe 448 is 3 inches from the proximate end 484 of the outer panel 414, the thread 424A between the white stripe 448 and proximate end 484 of the outer panel 414 could lie between 2 7/8 inch and 3 inches from the proximate end 484 of the outer panel 414, for example. The thread 424B on the opposite side of the white stripe 448, assuming the white stripe 448 to be 1 inch wide, could lie between 4 inches and 4 1/8 inches from the proximate end 484 of the outer panel 414, for example.

An advantage of the strips 440, causing the white stripes 448 to rise above the surrounding surface of the outer panel 414, strip 480 and the lines of thread 424 is an enhancement of the ability to grip the sports ball 410, particularly when the sports ball 410 is a football 412. Strips 440 and 480, as well as threads 424 can be used with logos, such as logos 146 or 246, by positioning a strip 440 or cutout 486 beneath the logo and/or stitching thread 424 about the perimeter of the logo just as done with stripes 448.

If desired, the strips 440 or strip 480 can be used in the sports ball 410 without using thread 424. In such an application, the strips 440 or the strip 480 can be secured at the seams between adjacent outer panels 414 and/or adhered to the outer panel 414 and/or inner layer 416 by a suitable adhesive between the strips 440 or strip 480 and outer panel 414 and/or inner layer 416.

While several embodiments of the present invention have been illustrated in the accompanying drawings and described in the foregoing Detailed Description, it will be understood that the invention is not limited to the embodiments disclosed, but is capable of numerous rearrangements, modifications and substitutions of parts and elements without departing from the scope and spirit of the invention.

The invention claimed is:

1. A football, comprising:

at least one inner layer having edges;

at least one outer panel having edges, the inner layer and outer panel being attached by sewing or gluing together at their edges;

a stripe on the outer panel, the football further having a strip between the inner layer and outer panel except under the stripe to form a void under the stripe wherein the strip is of open or closed cell foam having an uncompressed thickness of about 1/32 inch to $^1/_4$ inch, the stripe being about 3.75 inches long between the edges of the outer panel and about 1 inch wide, the strip tacked to either the outer panel or inner layer to aid in assembling the football, the only void between the outer panel and the inner layer being that created by a cutout in the strip forming the void under the stripe, the cutout having approximately the same dimensions as the stripe and lying directly beneath the stripe.

2. The football of claim 1 wherein the inner layer has a protruding line therein proximate an edge of the inner layer, the protruding line causing the outer panel to bulge slightly outward proximate the attachment between the edges of the inner layer and outer panel to enhance grip of the football, the protruding line being a line of thread sewn in the inner layer proximate the edge of the inner layer.

3. The football of claim 1 having four inner layers and four outer leather panels, a strip between any outer panel having a stripe and the underlying inner layer.

4. The football of claim 1 wherein the inner layer, outer panel and strip are attached together by a line of thread extending along each edge of a stripe.

5. The football of claim 1 further having a line of thread stitched through both the inner layer and outer panel and running on both sides of the stripe continuously between the edges of the inner layer and outer panel, the line of thread securing the strip to the inner layer and outer panel to prevent the void in the strip shifting from beneath the stripe, the line of thread stitched either outside the stripe or partially or wholly within the stripe, both the line of thread and the void beneath the stripe enhancing grip on the football.

6. The football of claim 5 wherein the line of thread is ⅛ inch wide and has about 9 to 10 thread stitches per inch.

* * * * *